US006884187B2

(12) United States Patent
Cataldi, Jr. et al.

(10) Patent No.: US 6,884,187 B2
(45) Date of Patent: Apr. 26, 2005

(54) TRAINING DEVICE FOR THROWING A BALL

(75) Inventors: Theodore F. Cataldi, Jr., Mc Kees Rocks, PA (US); Brian F. Hagen, Wexford, PA (US)

(73) Assignee: For You, Inc., McKees Rocks, PA (US)

( * ) Notice: Subject to any disclaimer, the term of this patent is extended or adjusted under 35 U.S.C. 154(b) by 114 days.

(21) Appl. No.: 10/376,165

(22) Filed: Mar. 1, 2003

(65) Prior Publication Data

US 2004/0171440 A1 Sep. 2, 2004

(51) Int. Cl.[7] ..... A63B 69/00

(52) U.S. Cl. ..... 473/451; 473/422; 473/452; 473/424

(58) Field of Search ..... 473/422–429, 473/68, 108, 393, 139, 575; 273/332–335; D21/721

(56) References Cited

U.S. PATENT DOCUMENTS

| | | | | | |
|---|---|---|---|---|---|
| 169,419 | A | * | 11/1875 | Clark | 473/571 |
| 795,960 | A | * | 8/1905 | Cook | 473/424 |
| 1,502,058 | A | * | 7/1924 | Quin | 473/575 |
| 1,826,221 | A | * | 10/1931 | Pearson | 473/575 |
| 2,942,883 | A | * | 6/1960 | Moore | 473/424 |
| 3,114,546 | A | * | 12/1963 | Verseghy | 482/87 |
| 3,214,166 | A | * | 10/1965 | Gaudet | 473/424 |
| 3,601,398 | A | * | 8/1971 | Brochman | 473/424 |
| 3,879,038 | A | * | 4/1975 | Tremblay | 473/576 |
| 3,907,287 | A | * | 9/1975 | Fox et al. | 473/424 |
| 4,088,319 | A | * | 5/1978 | Clarke | 473/575 |
| 4,174,107 | A | * | 11/1979 | Hickey | 473/423 |
| 4,415,155 | A | * | 11/1983 | Goudreau et al. | 473/424 |
| 4,460,172 | A | * | 7/1984 | Hogan | 473/426 |
| 4,846,471 | A | | 7/1989 | Haysom | |
| 5,056,781 | A | * | 10/1991 | Preston et al. | 473/423 |
| 5,238,241 | A | * | 8/1993 | Christensen | 473/424 |
| 5,250,016 | A | | 10/1993 | Higgins | |
| 5,560,604 | A | * | 10/1996 | Watts | 473/147 |
| 6,033,323 | A | * | 3/2000 | McCown | 473/424 |
| 6,368,241 | B1 | * | 4/2002 | Abel | 473/508 |

* cited by examiner

*Primary Examiner*—Mitra Aryanpour
(74) *Attorney, Agent, or Firm*—Clifford A. Poff

(57) ABSTRACT

A throwing exercise apparatus using a sphere with an internal polar passageway to deliver end portions a non-elastic band of which one end portion circumscribes the outer surface of the sphere and extends to the other end portion where they are joined together by a fastener. The band is then joined by an elastic member to an anchor so that in use there is established a path of elastic resistance along a tangential line formed by the wrapped part of a strap mid portion in response to an applied force comprising both translation and rotational motions of the sphere. The motions of the sphere bring about rotation of the internal polar passage in an end-over-end fashion.

9 Claims, 3 Drawing Sheets

TRAINING DEVICE FOR THROWING A BALL

CROSS-REFERENCE TO RELATED APPLICATIONS

Not applicable

BACKGROUND OF THE INVENTION

1. Field of the Invention

The present invention relates to a throwing exercise apparatus embodying a construction and relation of parts to impart progressive resistance to the wrist and forearm to train and strengthen the group of muscles namely forearm muscles, and collateral ligaments in the elbow properly due to the progressive resistance of an elongated anchor strap joined to a sphere in a way to impart progression of resistance due to the type of a strap attachment to a sphere.

2. Description of the Prior Art

U.S. Pat. Nos. 4,846,471 and 5,250,016 disclose throwing devices for use in training arm muscles by simulating a throwing motion. U.S. Pat. No. 4,846,471 discloses an elastic band passed through a horizontally orientated passageway in a baseball and the free ends of the band are joined by an adhesive connection using a dowel and mechanical clamps. Exercise is carried out to simulate pitching movement with the ends of the cord extending laterally from the ball so that the event of the cord touching the fingers of the exerciser is used to indicate improper pitching motion. U.S. Pat. No. 5,250,016 discloses a ball throwing training device with a rigid frame member forming a closed loop configuration large enough to accommodate the hand of a user to engage a ball rotatably mounted on a rod section of the frame. The frame is secured by elastic tubing to an anchor. The arrangement of parts allows the ball to rotate freely on the frame during use. The elastic cord is stretched by extensions of the user's arm. The freely rotatable ball on the rod or elastic cord of the prior art forms of exercise preclude benefits to the user because of a lack of rotation of a ball against resistance during a natural motion of throwing. The lack of resistance offers the exerciser little benefit or improper exercise to muscle groups other than the rotator cuff using such known forms of exercise equipment because resistance is not created at the end range of motion.

Accordingly, it is an object of the present invention to provide a throwing exercise apparatus constructed to provide progressive resistance through the entire natural progression of throwing a sphere and thereby derive beneficial exercise to enhance the natural motion of throwing a sphere such as a ball.

It is a further object of the present invention to provide resistance to wrist motion including collateral ligaments in the elbow during a variety of exercises using a sphere particularly a ball and elastic attachment cord to simulate throwing, shoulder girdle and similar exercise motion involving similar movement as part of the exercise.

SUMMARY OF THE INVENTION

According to the present invention there is provided a throwing exercise apparatus including the combination of a sphere having an exterior spherical surface containing first and second diametrically opposed access sites to an internal polar passage, an elongated anchor strap having a first strap mid portion traversing the internal polar passage and strap end portions interconnected by a fastener at the first access site to the internal polar passage, the elongated anchor strap having a second strap mid portion wrapped against a substantial part of the exterior spherical surface of the sphere between the second access site and the first access site to establish a path of elastic resistance along a tangential line formed by the wrapped part of the second strap mid portion in response to an applied force comprising both translation and rotational motions of the sphere, the internal polar passage rotating end-over-end by the rotational motions, and an elastic band anchored to a static structure at one end and joined to the strap end portions interconnected by a fastener.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
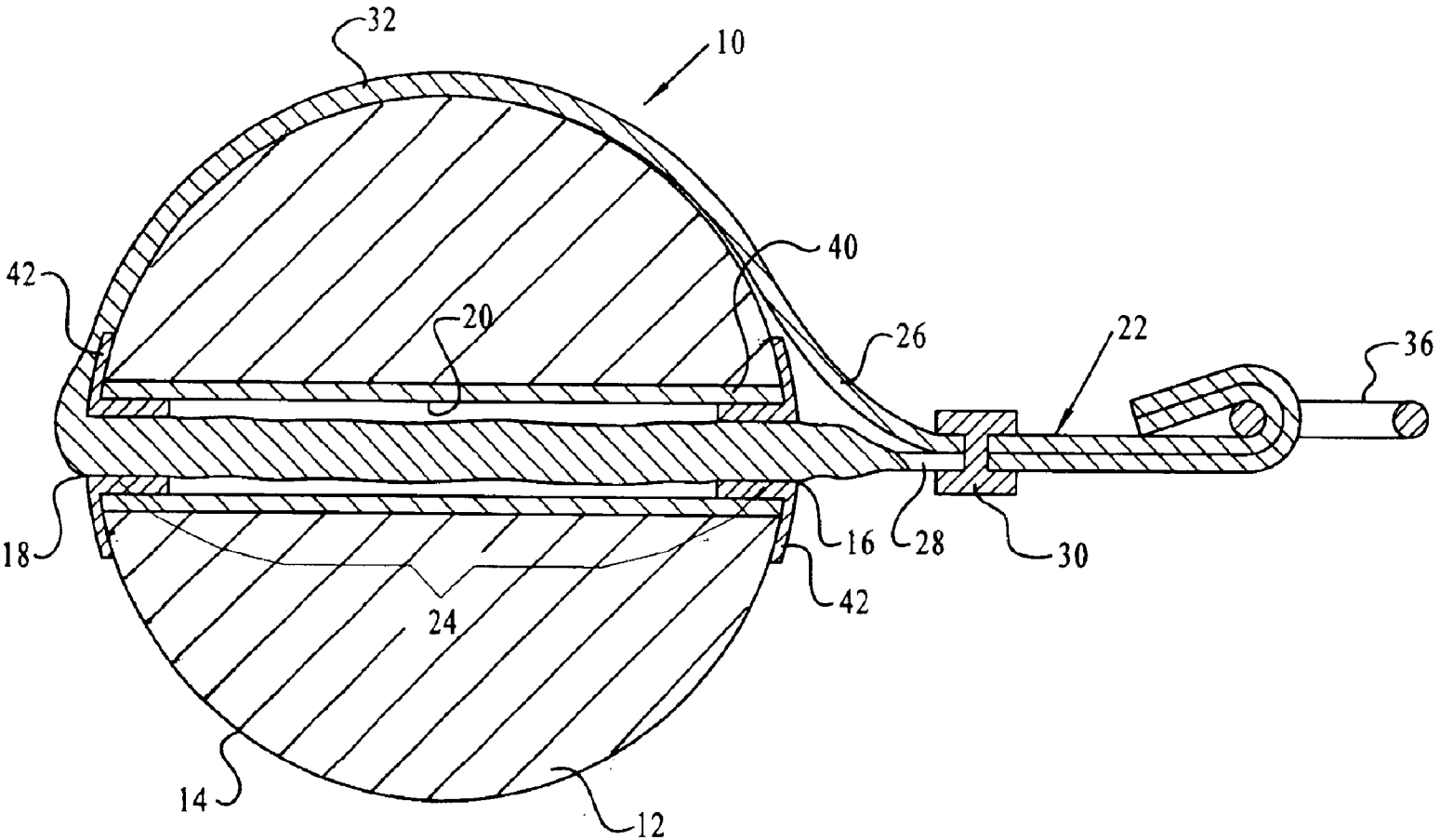
FIG. 1 is a sectional view across the equator of a spherical member such as a baseball and illustrating the apparatus of the present invention.
Figure 2:
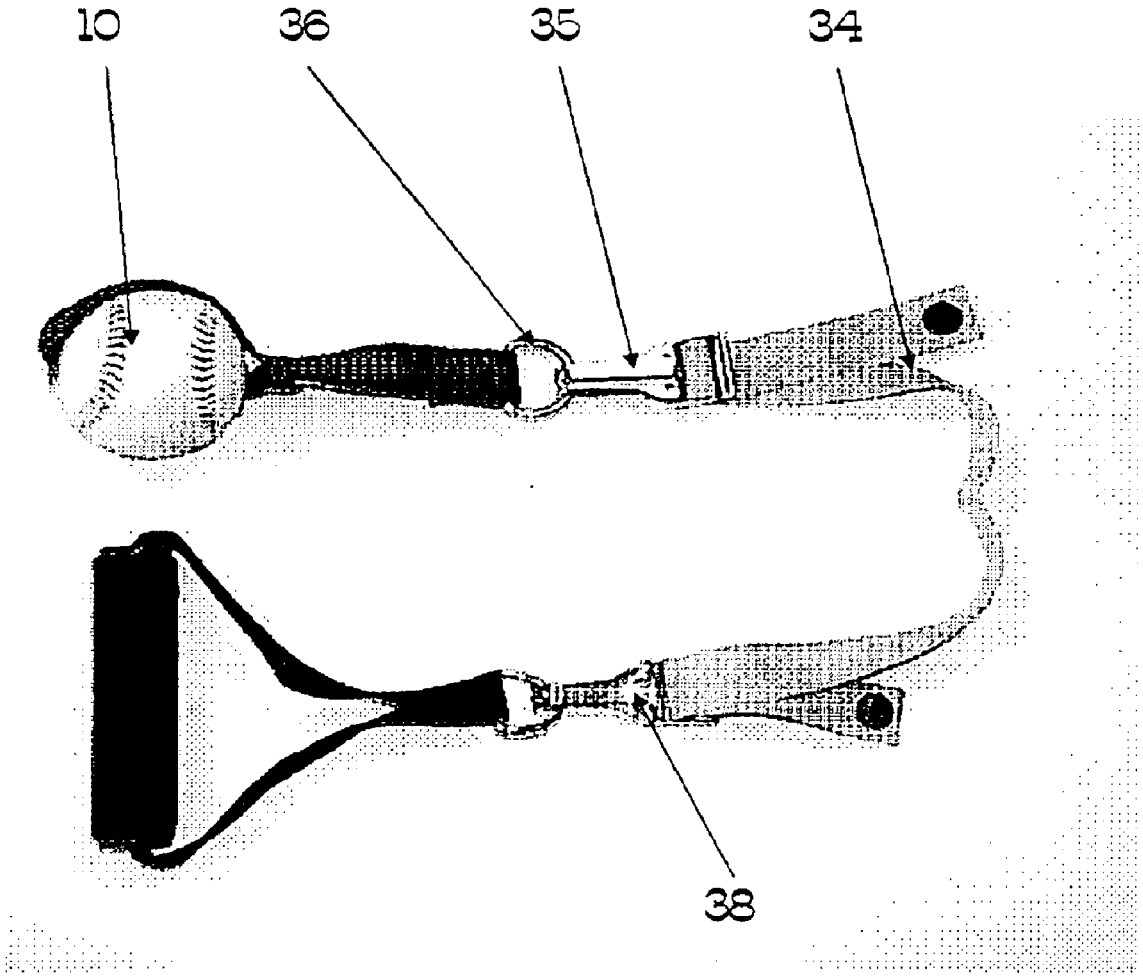
FIG. 2 is an illustration of the apparatus of FIG. 1 included with elastic member and anchor structure for completing the throwing exercise apparatus of the present invention.

Referring now to FIG. 1, the ball throwing exercise apparatus 10 of the present invention includes a sphere 12 typically a ball such as a baseball or softball, which has an exterior spherical surface 14 containing first and second diametrically opposed access sites 16 and 18, respectively, to an internal polar passage 20. An elongated anchor strap 22 includes a first strap mid portion 24 traversing the internal polar passage 20 and strap end portions 26 and 28 interconnected by a fastener 30 at the first access site 16 to internal polar passage 20. The elongated anchor strap 22 has a second strap mid portion 32 wrapped against a substantial part of the exterior spherical surface of the sphere 12 between the second access site 18 and the first access site 16 to establish a path of elastic resistance along a tangential line formed by the wrapped part of the second strap mid portion 32 in response to an applied force comprising both translation and rotational motions of the sphere 12. A feature of the exercise by the present invention brings about rotation of the internal polar passage 20 in an end-over-end relation by the rotational motion of the sphere. As shown in FIG. 2, an elastic band 34 is secured by a clasp 35 to a D-Ring 36 which is sewn into the material of the anchor strap 22. At the opposite end of the elastic band 34, there is a clasp 38 that can be used for securing the band to a suitable structure 39, a handle grip assembly being shown, to anchor the exercise device. Such anchorage can be provided by a fence post, a wire fence, or any other suitable static structure.

Preferably the anchor strap 22 is comprised of woven material such as nylon to impart a non-elastic property so that when engaged with the sphere the end portions of the strap remain in a fixed relation at one of the entrance sites to the polar passageway. To ensure a long continued static relation between the strap and the sphere it is preferred that the width of the strap corresponds to at least about three times the diameter of the opening to the internal polar passage so that the strap transforms from a flat configuration along the second mid strap portion 32 which is exteriorly about the sphere to a rolled shape interiorly along the internal polar passage. Thus, the width and thickness of the strap create sufficient bulk causing a tubular configuration of the first strap mid portion between generally plain configurations of the second strap mid portion and strap end portions. As shown in FIG. 1 the internal passageway is provided with a tubular barrier wall in the form of a sleeve 40 extending along the passageway into engagement with end portions of grommets 42 fitted into the internal passageway at the surface of the sphere.

Figure 3:
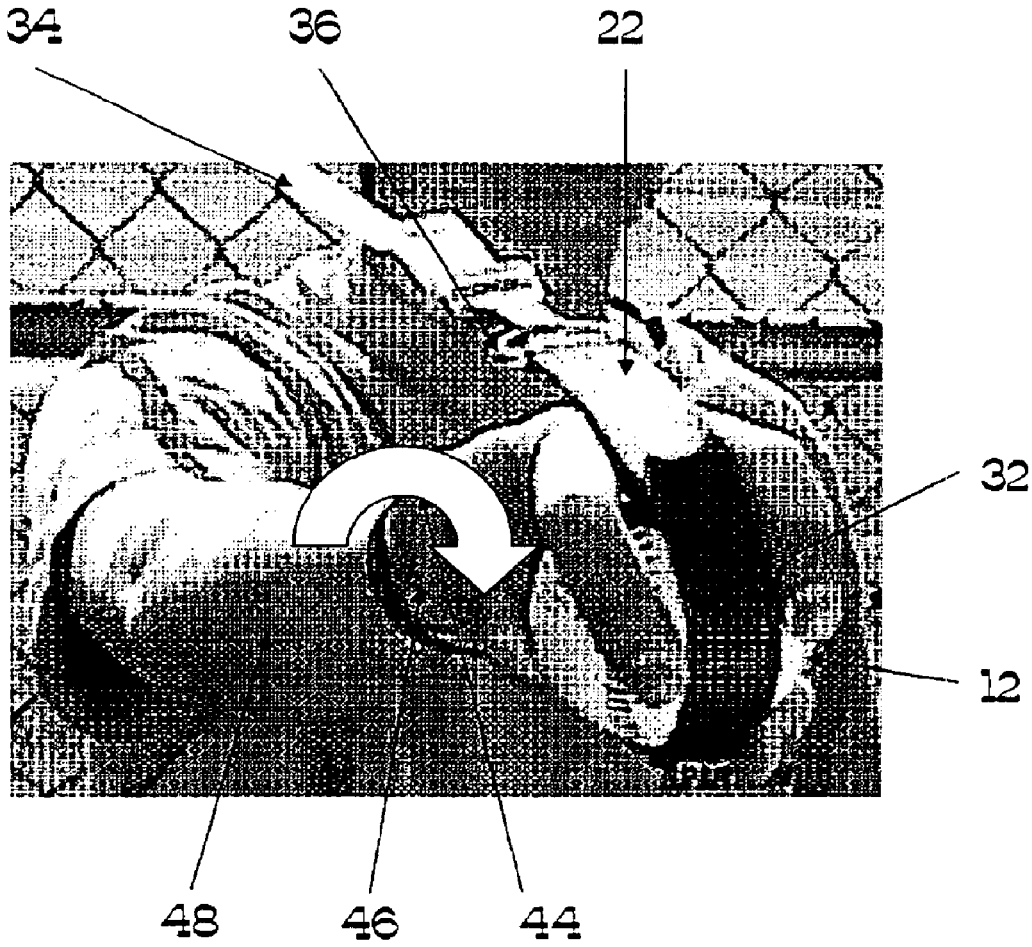
FIG. 3 is a pictorial illustration illustrating the manner of rotational resistance imparted by an exerciser to a device of the present invention.

Referring now to FIG. 3, the present invention provides a unique feature of creating biomechanical advantages not found in any other exercise or sport training device. The shape of the sphere 12 is used in a way to prevent free rotation to benefit the user of the device in a number of ways. Most importantly, the non-rotating sphere 12 particularly in a form of a baseball or a softball and position of the second strap mid portion 32 of the non-elastic strap 22 across the top of the ball provide a progressive resistance point during rotation of the ball, as shown by the arrow identified by reference numeral 44. This rotation occurs during the natural motion of throwing. This progressive resistance point across the ball is important primarily for one reason. That reason is to provide resistance to wrist motion which is also shown by the arrow identified by reference numeral 44 during a variety of exercises including simulated throwing, shoulder rotator cuff, shoulder girdle, and any exercises involving wrist movement as part of the exercise. This progressive resistance is delivered through the ball elastic resistance provided by the elastic band 34. This progressive resistance delivered to the wrist 46 and forearm musculature 48 during multi axial and multi planer motion is very important for several reasons.

The first reason is that is allows the forearm musculature to be strengthened in conjunction with the shoulder, shoulder girdle, trunk and lower extremity musculature simultaneously. This promotes muscle balance from a strength perspective. The balance being the forearm flexor musculature and extensor musculature in relation to the other body regions, in particular the shoulder. This is extremely important as it is well documented that elbow injuries are very prevalent in athletes who participate in baseball and softball. It is also well known that these injuries occur with throwing a very high percentage of the time and that they are often from overuse or overstrain of the forearm muscles, musculotendinous junction, and collateral ligaments in the elbow.

The second reason is that providing resistance simultaneously to the forearm allows for neural timing (the brain, nerve and muscle interaction gauging force, velocity and muscle synchronicity during multi planer movements) to be properly trained. The throwing apparatus of the present invention allows a very important group of muscles, namely forearm muscles, and collateral ligaments in the elbow to be strengthened and trained properly due to the progressive resistance of the non-elastic strip over the ball and the progression of resistance due to this type of an attachment.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A throwing exercise apparatus including the combination of:

a sphere having an exterior spherical surface containing first and second diametrically opposed access sites to an internal polar passage;

an elongated anchor strap having a first strap mid portion traversing said internal polar passage and strap end portions interconnected by a fastener at said first access site to said internal polar passage, said elongated anchor strap having a second strap mid portion wrapped against a part of said exterior spherical surface of said sphere between said second access site and said first access site to establish a path of elastic resistance along a tangential line formed by the wrapped part of said second strap mid portion in response to an applied force comprising both translation and rotational motions of said sphere, said elongated anchor strap having a width and a thickness creating sufficient bulk to insure a long continued static relation with said sphere by transforming from a rolled shape in said internal polar passage to generally plainer configurations along said second strap mid portion and said strap end portions; and an elastic band anchored to a static structure at one end and joined to said strap end portions interconnected by said fastener to provide progressive resistance by said rotational motion of said internal polar passage and by said translation motion to the wrist and forearm musculature during multi axial and multi planer motions delivered through the ball elastic resistance provided by said elastic band.

2. The throwing exercise apparatus according to claim 1 further including a tubular barrier wall extending along said internal polar passage and grommets surrounding said first and second diametrically opposed access sites.

3. The throwing exercise apparatus according to claim 1 further including a connection fixture secured to end portions of said elongated anchor strap projecting from said sphere beyond said fastener.

4. The throwing exercise apparatus according to claim 1 wherein said elongated anchor strap has a width approximately three times the diameter of an annular opening defining said internal polar passage for impeding traversing motion of said second strap mid portion along said internal polar passageway.

5. The throwing exercise apparatus according to claim 1 wherein said fastener is sufficiently proximal said first access site to direct the wrapped part of said second strap mid portion toward said first access site.

6. The throwing exercise apparatus according to claim 1 wherein said sphere is a baseball.

7. The throwing exercise apparatus according to claim 1 wherein said sphere is a softball.

8. The throwing exercise apparatus according to claim 1 wherein said elongated anchor strap is non-elastic.

9. The throwing exercise apparatus according to claim 1 wherein said elongated anchor strap comprises woven nylon filament.

* * * * *